US005507497A

United States Patent [19]

Sivak

[11] Patent Number: 5,507,497

[45] Date of Patent: Apr. 16, 1996

[54] RANDOM CATEGORY NAMING GAME

[76] Inventor: Anne M. Sivak, 271 Montana Ave., Trenton, N.J. 08619

[21] Appl. No.: 412,937

[22] Filed: Mar. 29, 1995

[51] Int. Cl.[6] ..... A63F 9/00

[52] U.S. Cl. ..... 273/429

[58] Field of Search ..... 273/459, 429–432, 273/284, 272, 409, 283, 294

[56] References Cited

U.S. PATENT DOCUMENTS

| | | | |
|---|---|---|---|
| 1,203,472 | 10/1916 | Branch | 273/409 |
| 3,309,092 | 3/1967 | Hardesty et al. | 273/284 X |
| 4,123,051 | 10/1978 | Tsacoyannis | 273/272 X |
| 4,198,047 | 4/1980 | Scott et al. | 273/459 |
| 4,222,561 | 9/1980 | Whitten | 273/429 |
| 4,592,553 | 6/1986 | Mammen et al. | 273/272 X |
| 4,852,885 | 8/1989 | Baratpour et al. | 273/272 X |
| 4,911,452 | 3/1990 | Marchese, Jr. | 273/272 X |
| 4,948,146 | 8/1990 | Snyder et al. | 273/283 X |

*Primary Examiner*—Paul E. Shapiro

[57] ABSTRACT

A game for stimulating the memory of an individual. The inventive device includes a main board having a plurality of tiles positioned thereon. Each of the tiles includes a category name printed thereon. A die can be tossed onto the tiles, whereby a player is then required to a name a number of items within the category upon which the die comes to rest. Score is kept over a predetermined length of time with a winner being declared as a player having the highest number of points.

8 Claims, 4 Drawing Sheets

PRIOR ART

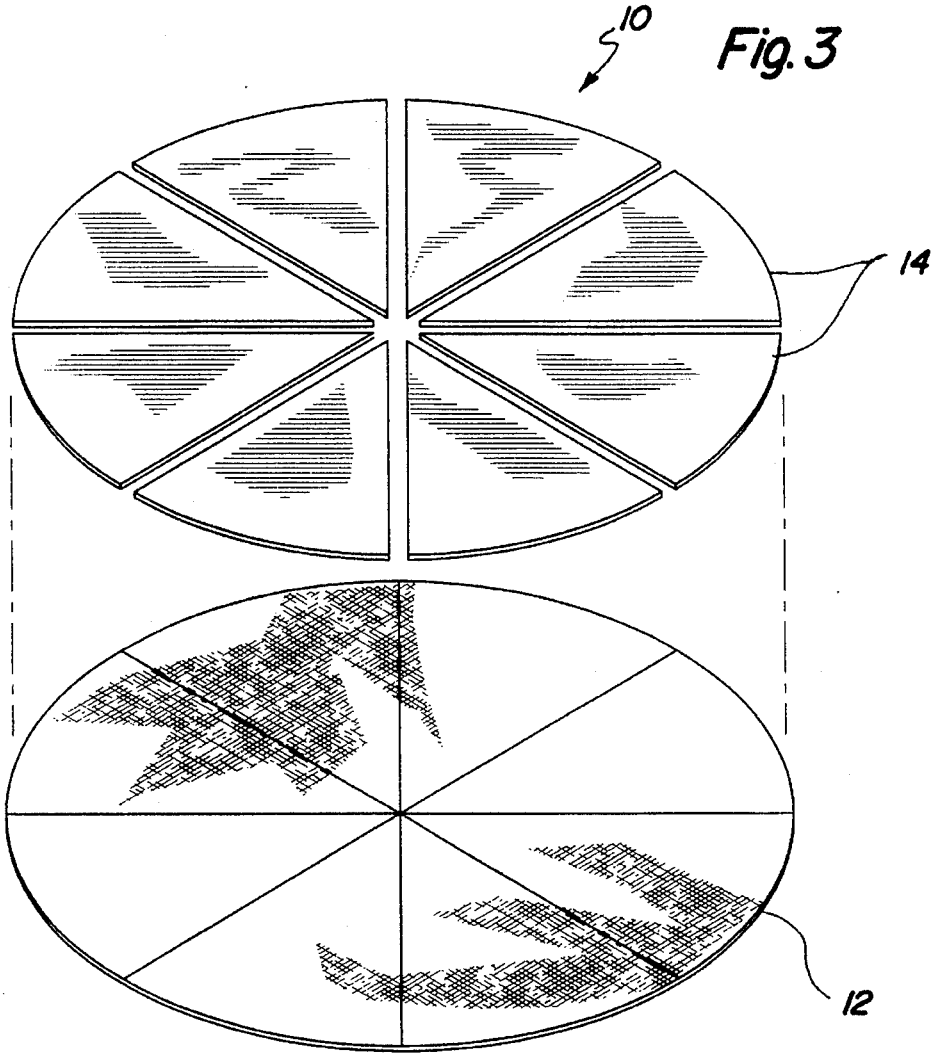
Fig. 3
Fig. 4
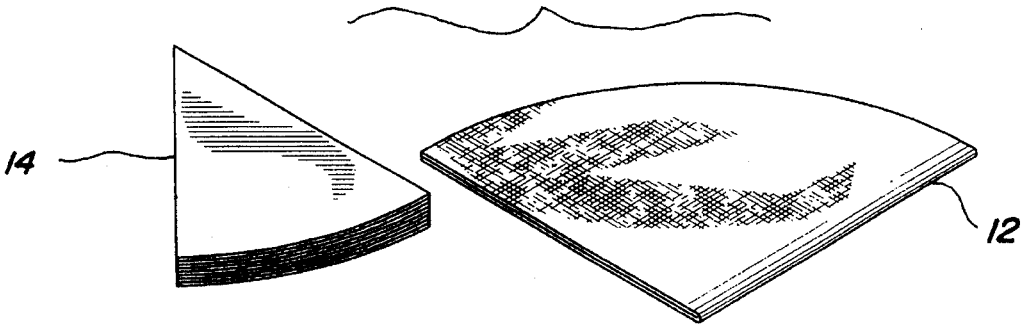

RANDOM CATEGORY NAMING GAME

BACKGROUND OF THE INVENTION

1. Field of the Invention

The present invention relates to board games and more particularly pertains to a random category naming game for stimulating the memory of an individual.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. Nos. 5,145,184; 5,273,431; 5,244,391; 4,184,686; and U.S. Pat. No. 301,254.

While these devices fulfill their respective, particular objectives and requirements, the aforementioned patents do not disclose a random category naming game for stimulating the memory of an individual which includes a main board having a plurality of tiles each having a category name printed thereon positioned on the main board, wherein a die can be tossed onto the tiles such that a player is then required to name a number of items within the category upon which the die comes to rest, with score being kept over a predetermined time and the winner being declared as a player having the highest number of points.

In these respects, the random category naming game according to the present invention substantially departs from the conventional concepts and designs of the prior art, and in so doing provides an apparatus primarily developed for the purpose of stimulating the memory of an individual.

SUMMARY OF THE INVENTION

In view of the foregoing disadvantages inherent in the known types of board games now present in the prior art, the present invention provides a new random category naming game construction wherein the same can be utilized for entertaining and stimulating the memory of an individual. As such, the general purpose of the present invention, which will be described subsequently in greater detail, is to provide a new random category naming game apparatus and method which has many of the advantages of the board games mentioned heretofore and many novel features that result in a random category naming game which is not anticipated, rendered obvious, suggested, or even implied by any of the prior art board games, either alone or in any combination thereof.

To attain this, the present invention generally comprises a game for stimulating the memory of an individual. The inventive device includes a main board having a plurality of tiles positioned thereon. Each of the tiles includes a category name printed thereon. A die can be tossed onto the tiles, whereby a player is then required to a name a number of items within the category upon which the die comes to rest. Score is kept over a predetermined length of time with a winner being declared as a player having the highest number of points.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new random category naming game apparatus and method which has many of the advantages of the board games mentioned heretofore and many novel features that result in a random category naming game which is not anticipated, rendered obvious, suggested, or even implied by any of the prior art board games, either alone or in any combination thereof.

It is another object of the present invention to provide a new random category naming game which may be easily and efficiently manufactured and marketed.

It is a further object of the present invention to provide a new random category naming game which is of a durable and reliable construction.

An even further object of the present invention is to provide a new random category naming game which is susceptible of a low cost of manufacture with regard to both materials and labor, and which accordingly is then susceptible of low prices of sale to the consuming public, thereby making such random category naming games economically available to the buying public.

Still yet another object of the present invention is to provide a new random category naming game which provides in the apparatuses and methods of the prior art some of the advantages thereof, while simultaneously overcoming some of the disadvantages normally associated therewith.

Still another object of the present invention is to provide a new random category naming game for entertaining an individual and stimulating the memory thereof.

Yet another object of the present invention is to provide a new random category naming game which includes a main board having a plurality of tiles each having a category name printed thereon positioned on the main board, wherein a die can be tossed onto the tiles such that a player is then required to name a number of items within the category upon which the die comes to rest, with score being kept over a predetermined time and the winner being declared as a player having the highest number of points.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded isometric illustration of a random category naming game according to the present invention.

FIG. 4 is an isometric illustration of the game in a compacted configuration.

DESCRIPTION OF THE PREFERRED EMBODIMENT

Figure 1:
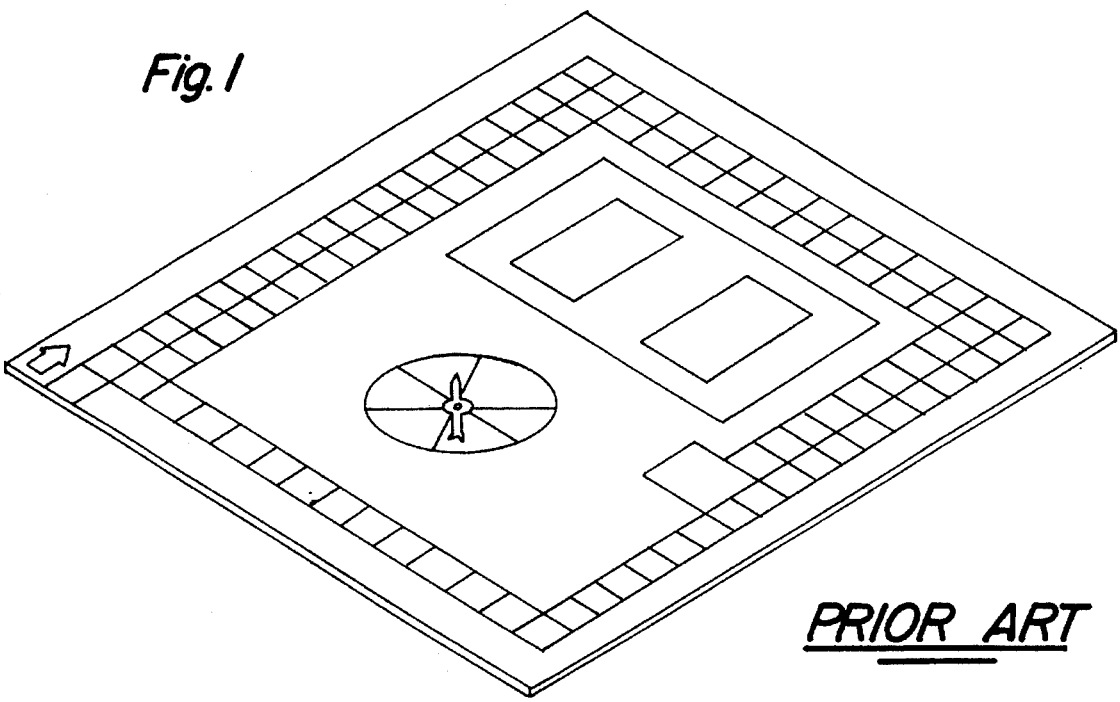
FIG. 1 is an isometric illustration of a prior art board game.

With reference now to the drawings, and in particular to FIGS. 3–8 thereof, a new random category naming game embodying the principles and concepts of the present invention and generally designated by the reference numeral 10 will be described.

Figure 2:
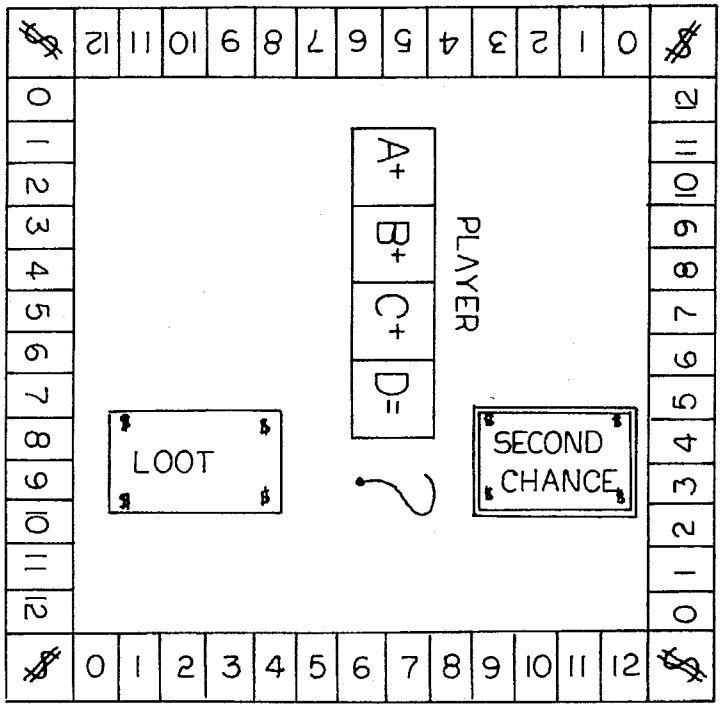
PRIOR ART Fig. 2
FIG. 2 is a top plan view of a further prior art board game.

Turning initially to FIGS. 1 and 2, it can be shown that the prior art board games disclose rectangular board games wherein a playing piece is selectively advanced along a perimeter of the board.

Figure 5:
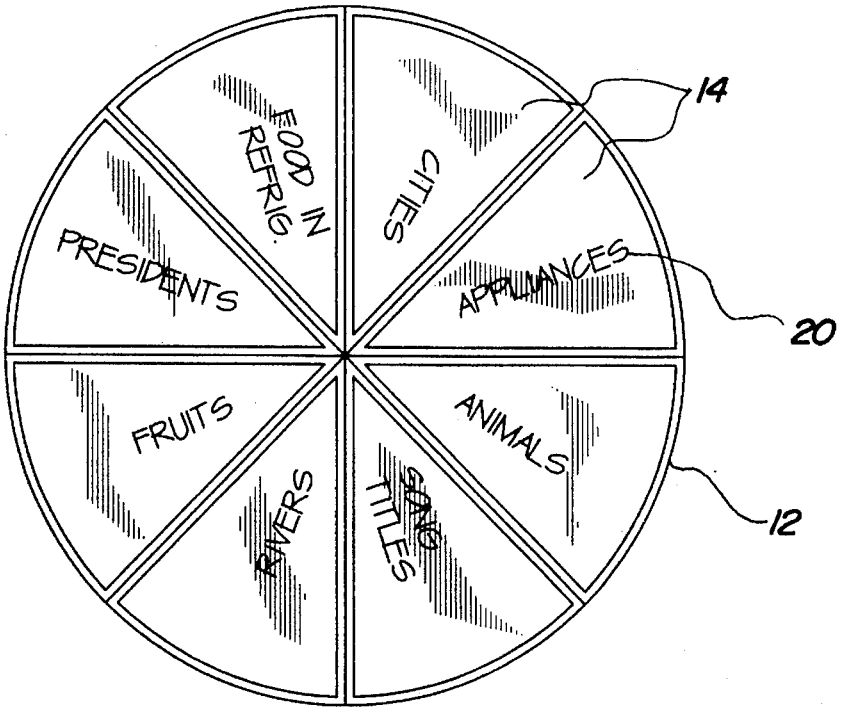
FIG. 5 is a top plan view of the invention.
Figure 6:
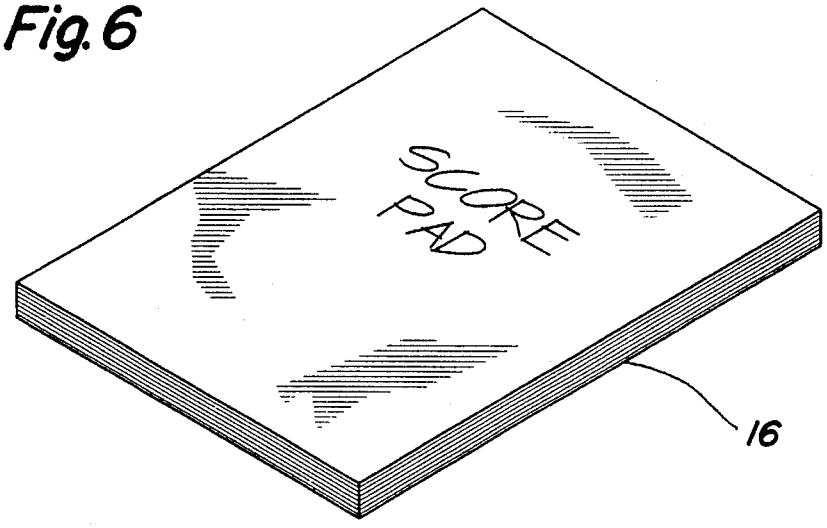
FIG. 6 is an isometric illustration of a further portion of the present invention.
Figure 7:
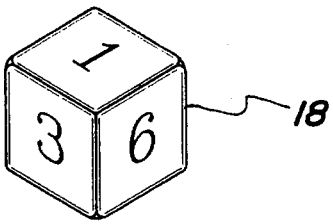
FIG. 7 is an isometric illustration of yet a further portion of the present invention.
Figure 8:
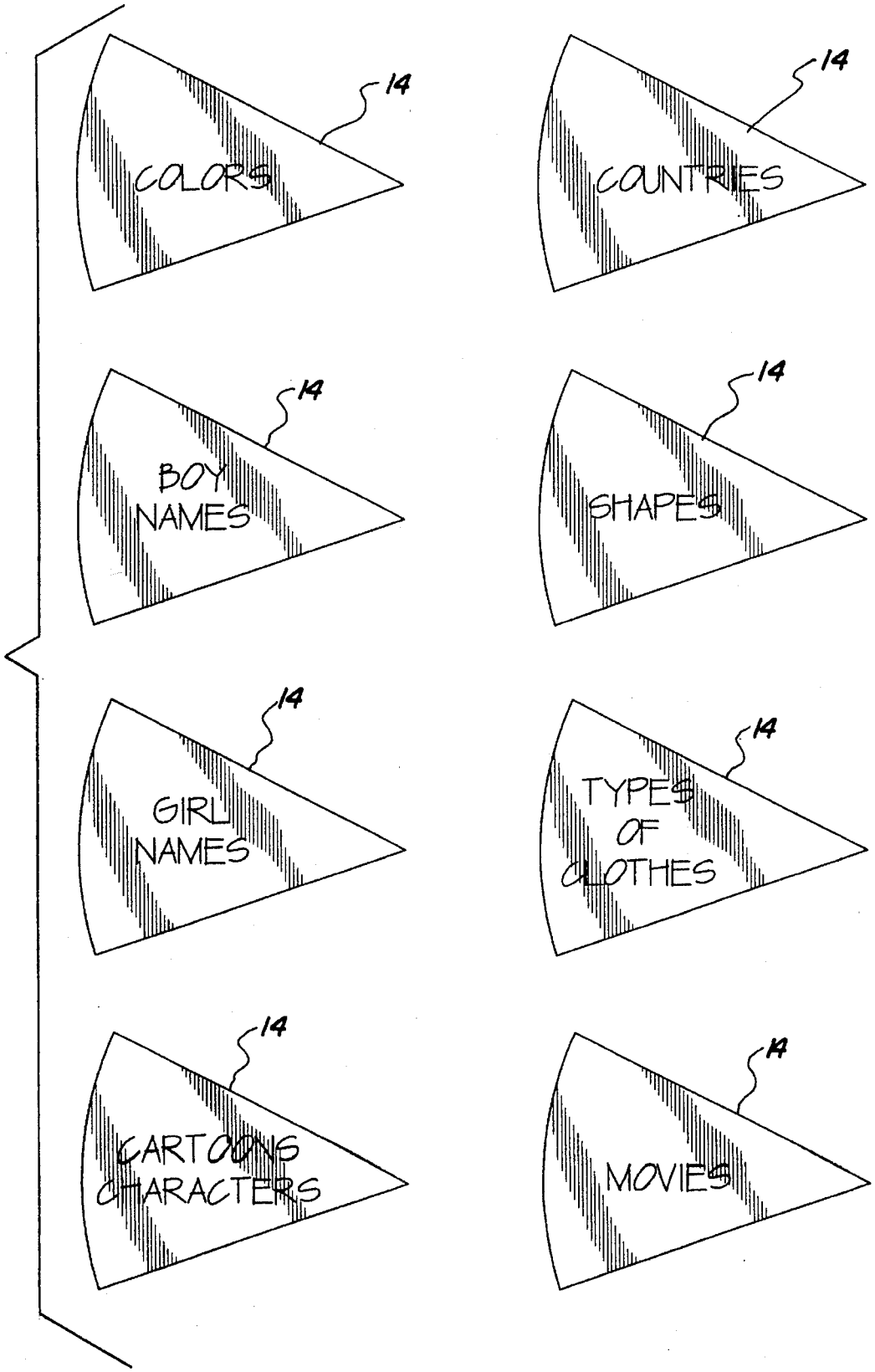
FIG. 8 is a plan view of a plurality of cover tiles according to the present invention.

Turning now to FIGS. 3 through 8 wherein the random category naming game 10 according to the present invention is illustrated in detail, it can be shown that the same substantially departs from the designs and methods of the prior art and comprises a main board 12 of preferably substantially circular configuration, and a plurality of cover tiles 14 cooperatively positionable over the main board 12 so as to coextensively cover the main board. To this end, the cover tiles 14 when assembled as shown in FIG. 5 define an outer periphery substantially equal in configuration to the outer periphery of the main board 12. Although the present invention 10 is illustrated as being substantially circular in design and configuration, it is within the intent and purview of the present invention to shape the main board 12 in any desired geometrical shape, such as a square, a rectangle, or any other polygonal shape. As shown in FIG. 4, the cover tiles 14 can be selectively removed from the main board 12, with the main board being compactly folded into quarters for storage and/or transportation purposes. The cover tiles 14 may simply be loosely positioned on top of the main board 12, or alternatively, may include a fabric fastening material such as "VELCRO" interposed between the cover tiles 14 and the main board 12 so as to secure the cover tiles 14 relative to the main board 12. As shown in FIG. 6, a score pad 16 can be provided for use with the present invention 10 to permit recording of scores in a current or previous game. As shown in FIG. 7, a die 18 or, if desired, a pair of unillustrated dice, can be provided for use with the present invention 10 in a manner which will subsequently be described in more detail. Referring now to FIG. 8, it can be shown that the cover tiles 14 is provided with category indicia 20 printed thereon, wherein each of the cover tiles 14 is provided with a disparate category indicia. The cover tiles 14 can thus be randomly arranged on top of the main board 12 for use of the device 10 during a game method as will be described below.

A method of playing the game 10 of the present invention may be accomplished by initially positioning the cover tiles 14 onto the main board 12 in a random or desired orientation. The die 18 can then be tossed onto the cover tiles 14 residing on top of the main board 12, whereby the die will land or come to rest upon one of the cover tiles 14 with a pip of the die resting in an upward facing direction. The player passing the die 18 is then required to recite a number of items corresponding to the category indicia 20 of the cover tile 14 within which the die 18 has come to rest. The number of items recited may be a predetermined number, but is preferably equal to the pip showing on the die 18. For example, an individual throwing the die 18 onto the cover tiles 14 as illustrated in FIG. 5, would be required to name a plurality of animals should the die come to rest within the cover tile 14 having the category indicia 20 "ANIMALS" printed thereon. Should the upwardly facing pip of the die 18 have the number three showing, the individual would then be required to recite three animals, such as a lion, a tiger, and a bear. Thus, the present invention 10 serves to stimulate the memory of an individual during entertainment of such individual as a result of the game method 10. Score is kept within the score pad 16 by recording a point for each correct answer given which corresponds to the respective category indicia 20 of the cover tile 14 upon which the die 18 has come to rest. A winner is declared as a player having the highest score after a predetermined length of time has elapsed.

Variations of the game method of the present invention include placing a plurality of the cover tiles 14 on top of one another, whereby an individual may choose one of the cover tiles 14 having a desired category indicia 20 thereon or play of the method. Further, a number of items to be named as a result of the die 18 coming to rest upon one of the cover tiles 14 may be limited by a time such as a thirty second time period. In other words, upon the die 18 coming to rest on one of the cover tiles 14, an individual would have a selected time period into which to respond, wherein the individual is free to name as many items within the category as possible within the time period.

In use, the random category naming game 10 according to the present invention serves to mentally stimulate and create inner action between players. The game method may be varied as described above such that older or elderly players are continuously challenged so as to increase mental awareness, reality orientation, and social interaction with other individuals.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A random category naming game comprising:

a main board;

a plurality of cover tiles cooperatively positioned over the main board so as to coextensively cover the main board in a first orientation, the cover tiles being randomly repositionable over the main board so as to coextensively cover the main board in a second orientation, the cover tiles each including category indicia printed thereon, wherein each of the cover tiles is provided with disparate category indicia relative to other cover tiles.

2. A method of playing a random category naming game comprising the steps of:

providing a main board;

providing a plurality of cover tiles, the cover tiles each including category indicia printed thereon, wherein each of the cover tiles is provided with disparate category indicia relative to other cover tiles;

positioning the cover tiles onto the main board;

providing a die;

tossing the die onto the cover tiles residing on top of the main board, whereby the die will come to rest upon one of the cover tiles with a pip of the die resting in an upward facing direction;

naming a number of items corresponding to the category indicia of the cover tile upon which the die has come to rest.

3. The method of playing a random category naming game of claim 2, wherein the step of naming a number of items corresponding to the category indicia of the cover tile upon which the die has come to rest comprises naming a number of items corresponding to the category indicia of the cover tile within which the die has come to rest, wherein the number equals the pip showing on the die.

4. The method of playing a random category naming game of claim 3, and further comprising the step of scoring a predetermined number of points for each correct answer given which corresponds to and falls under the respective category indicia of the cover tile upon which the die has come to rest.

5. The method of playing a random category naming game of claim 4, wherein a winner is declared as a player having the highest score after a predetermined length of time has elapsed.

6. The method of playing a random category naming game of claim 2, wherein the step of positioning the cover tiles onto the main board comprises positioning a plurality of the cover tiles stacked on top of one another to define stacked cover tiles; and further wherein the step of naming a number of items corresponding to the category indicia of the cover tile upon which the die has come to rest comprises naming a number of items corresponding to the category indicia of one of the stacked cover tiles upon which the die has come to rest.

7. The method of playing a random category naming game of claim 6, wherein the step of naming a number of items corresponding to the category indicia of one of the stacked cover tiles upon which the die has come to rest comprises naming a number of items corresponding to the category indicia of one of the stacked cover tiles upon which the die has come to rest within a predetermined time period.

8. The method of playing a random category naming game of claim 2, wherein the step of naming a number of items corresponding to the category indicia of the cover tile upon which the die has come to rest comprises naming a number of items corresponding to the category indicia of the cover tile upon which the die has come to rest within a predetermined time period.

* * * * *